US010422094B2

(12) United States Patent
Kim

(10) Patent No.: US 10,422,094 B2
(45) Date of Patent: Sep. 24, 2019

(54) CONCRETE BLOCK CONSTRUCTION METHOD AND GUIDE MEMBER FOR INSTALLING CONCRETE BLOCK

(71) Applicant: Sang Gi Kim, Busan (KR)

(72) Inventor: Sang Gi Kim, Busan (KR)

( * ) Notice: Subject to any disclaimer, the term of this patent is extended or adjusted under 35 U.S.C. 154(b) by 0 days.

(21) Appl. No.: 16/327,074

(22) PCT Filed: Jul. 25, 2017

(86) PCT No.: PCT/KR2017/007988
§ 371 (c)(1),
(2) Date: Feb. 21, 2019

(87) PCT Pub. No.: WO2018/038406
PCT Pub. Date: Mar. 1, 2018

(65) Prior Publication Data

US 2019/0194893 A1 Jun. 27, 2019

(30) Foreign Application Priority Data

Aug. 24, 2016 (KR) ..... 10-2016-0107518

(51) Int. Cl.
*E02B 3/04* (2006.01)
*E02D 23/08* (2006.01)
(Continued)

(52) U.S. Cl.
CPC ..... *E02B 3/04* (2013.01); *E02D 23/00* (2013.01); *E02D 23/08* (2013.01); *E02D 25/00* (2013.01);
(Continued)

(58) Field of Classification Search
CPC ..... E02B 3/04; E02D 23/00; E02D 23/08; E02D 25/00; E02D 2250/0061; E02D 2600/20
See application file for complete search history.

(56) References Cited

U.S. PATENT DOCUMENTS 3,307,871 A * 3/1967 Russell ..... B66C 1/66 294/86.4
6,189,282 B1 * 2/2001 VanderWerf ..... E04B 2/14 52/582.1
(Continued)

FOREIGN PATENT DOCUMENTS

JP H05-239924 A 9/1993
JP 2000-247571 A 9/2000
(Continued)

OTHER PUBLICATIONS

International Search Report for PCT/KR2017/007988 dated Sep. 26, 2017 from Korean Intellectual Property Office.

*Primary Examiner* — Benjamin F Fiorello
(74) *Attorney, Agent, or Firm* — Paratus Law Group, PLLC

(57) ABSTRACT

A concrete block construction method, including: manufacturing a plurality of concrete blocks each having a vertical guide hole formed in a vertical direction; preparing a guide member for installing the concrete blocks; forming a lower concrete block structure by installing at least one of the concrete blocks; placing the concrete block subject to be installed on the lower concrete block structure by inserting the installation guide pole into the vertical guide hole of the concrete block subject to be installed; and separating and recovering the guide member for installing the concrete block from the concrete block subject to be installed, after placing the concrete block subject to be installed.

6 Claims, 9 Drawing Sheets

(51) Int. Cl.
*E02D 25/00* (2006.01)
*E02D 23/00* (2006.01)

(52) U.S. Cl.
CPC .. *E02D 2250/0061* (2013.01); *E02D 2600/20* (2013.01)

(56) References Cited

U.S. PATENT DOCUMENTS

| | | | | |
|---|---|---|---|---|
| 9,303,400 | B2 * | 4/2016 | Maeers | E04B 2/16 |
| 9,932,737 | B1 * | 4/2018 | Muirhead | E04G 21/147 |
| 2003/0138296 | A1 * | 7/2003 | O'Hare | E02B 3/06 405/25 |
| 2006/0059817 | A1 * | 3/2006 | Fleming | B66C 1/442 52/379 |
| 2013/0036700 | A1 * | 2/2013 | Speer | E04B 2/16 52/583.1 |
| 2013/0326967 | A1 * | 12/2013 | Kim | B66C 1/666 52/125.4 |
| 2018/0266106 | A1 * | 9/2018 | Muirhead | E04B 2/20 |

FOREIGN PATENT DOCUMENTS

| | | | |
|---|---|---|---|
| KR | 20-0231243 | Y1 | 7/2001 |
| KR | 20-0245001 | Y1 | 10/2001 |
| KR | 10-1220995 | B1 | 1/2013 |
| KR | 10-1355805 | B1 | 1/2014 |

* cited by examiner

CONCRETE BLOCK CONSTRUCTION METHOD AND GUIDE MEMBER FOR INSTALLING CONCRETE BLOCK

CROSS REFERENCE TO PRIOR APPLICATIONS

This application is a National Stage Patent Application of PCT International Patent Application No. PCT/KR2017/007988 (filed on Jul. 25, 2017) under 35 U.S.C. § 371, which claims priority to Korean Patent Application No. 10-2016-0107518 (filed on Aug. 24, 2016), which are all hereby incorporated by reference in their entirety.

BACKGROUND

The present invention relates to a concrete block construction method and a guide member for installing a concrete block and, more particularly, to a concrete block construction method for forming a concrete block structure and a guide member for installing the concrete block.

Generally, a structure constructed in the water should not be affected by displacement of the water and meet objectives such as functioning as a berth facility, etc.

As a method for constructing an underwater structure, a method using huge caissons is widely known. The method using caissons can withstand large waves, but has many difficulties such as high cost of construction and impossibility of construction in shallow water.

In order to solve the problem of the method using caissons described above, a method for constructing a structure by piling small concrete blocks in multiple levels according to water levels is known.

When such underwater structure is constructed, it is difficult to cast concrete in the water, and thus, a concrete block is usually manufactured on the ground and then installed in the water. The concrete block manufactured on the ground and installed in the water is called as an underwater block.

In the case of an underwater block, a concrete block having a relative small size is used rather than the method using caissons. Therefore, the underwater block has low cost of construction and is applicable to various field conditions.

Meanwhile, when underwater blocks are constructed, an underwater block subject to be installed should be seated to an accurate position considering a position of a lower underwater block and a position of an underwater block positioned at a side.

However, it is difficult to fit the underwater block to its accurate position and to seat the underwater block.

A diver should inform a crane operator of the accurate position of the underwater block from the water, but it is difficult for the diver to recognize the accurate position of the underwater block because of lack of visibility in the water. Moreover, although the diver recognizes the accurate position of the underwater block, it is difficult to accurately inform the crane operator of positional information.

SUMMARY

Accordingly, the present invention has been made keeping in mind the above problems occurring in the prior art, and an object of the present invention is to provide a concrete block construction method in which a concrete block can be seated at an accurate position considering a position of a lower concrete block and a position of a concrete block positioned at a side during installing the concrete block, and to provide a guide member for installing the concrete block.

In order to accomplish the above object, the present invention provides a concrete block construction method, the method including: manufacturing a concrete block having a vertical guide hole formed in a vertical direction; preparing a guide member for installing the concrete block, which includes an installation guide pole provided with a guide body having a cross-sectional shape corresponding to the vertical guide holes and extended in the vertical direction, a cap formed on an upper part of the guide body and having a stopping step protruding from a rim thereof, and an insertion guide part positioned at a lower part of the guide body and of which cross-sectional area gradually decreases in a downward direction; forming a lower concrete block structure by installing at least one of the concrete blocks; placing the concrete block subject to be installed on the lower concrete block structure by inserting the installation guide pole into the vertical guide hole of the concrete block subject to be installed, positioning the guide body inside the vertical guide hole of the concrete block subject to be installed until the stopping step of the cap stops at an upper surface of the concrete block subject to be installed, lifting the concrete block subject to be installed using a separate lifting means while the insertion guide part protrudes from a bottom of the concrete block subject to be installed, and then inserting the insertion guide part of the installation guide pole into a vertical guide hole of the lower concrete block structure and placing the concrete block subject to be installed on the lower concrete block structure, so that the vertical guide hole of the concrete block subject to be installed is positioned directly above the vertical guide hole of the lower concrete block structure with guidance of the installation guide pole; and separating the guide member for installing the concrete block from the concrete block subject to be installed, after placing the concrete block subject to be installed.

The guide member for installing the concrete block may preferably include a plurality of installation guide poles and a horizontal spacer from which the plurality of installation guide poles are suspended while maintaining horizontal spacing therebetween, a plurality of vertical guide holes are formed on the concrete block, and a center-to-center length in a horizontal direction of the guide holes adjacent to each other is twice a length from a first side of the concrete block to a center of an adjacent guide hole.

The guide member for installing the concrete block may further include a crane connecting cable for connecting a lifting part of a crane and the horizontal spacer 210, and wherein, when the lifting part of the crane is separated from the concrete block subject to be installed, the guide member for installing the concrete block may be separated from the concrete block subject to be installed with the lifting part of the crane.

The method may further include: inserting a vertical reinforcing bar module into vertical guide holes of a plurality of concrete blocks arranged continuously in the vertical direction, by inserting the vertical reinforcing bar module which is formed vertically and covered by a waterproof membrane on lower and side parts thereof into the vertical guide holes from an exposed upper part to a lower part, after the guide member for installing the concrete block is separated from the concrete block subject to be installed; and forming a vertical concrete column for joining formed along the vertical guide holes arranged in the vertical direction by casting concrete in the guide holes in which the vertical reinforcing bar module is inserted.

In another aspect of the present invention, when the concrete block having a plurality of guide holes extended in a vertical direction and are spaced from each other in a horizontal direction is being placed, a guide member for installing a concrete block for guiding the concrete block to a placing position of the concrete block may include: a horizontal spacer extended in a horizontal direction; a plurality of installation guide poles each including a guide body extended in the vertical direction so as to be inserted into a vertical guide hole of the concrete block, a cap formed on an upper part of the guide body and having a stopping step protruding so that the cap stops at an upper surface of the concrete block when the guide body is in an inserted state in the vertical guide hole, and a insertion guide part formed on a lower part of the guide body, having cross-sectional area gradually decreasing in a downward direction, and protruding at a lower part of the concrete block when the guide body is inserted in the guide hole of the concrete block; and a cap connecting member for connecting the cap and the horizontal spacer so that the plurality of the installation guide poles are suspended from the horizontal spacer while maintaining horizontal spacing therebetween, and for allowing the installation guide poles to move freely.

Hereinabove, wherein the horizontal spacer may have a length variable structure, and the horizontal spacing between the plurality of installation guide poles is adjusted by the variable length of the horizontal spacer.

As described above, when the concrete block is installed, the present invention can allow the concrete block to be easily placed in an accurate position so that the concrete block is aligned to positions of a lower concrete block and a side concrete block. Therefore, construction of the concrete block according to the present invention can be accurate and a construction speed thereof can be drastically increased.

DETAILED DESCRIPTION

Figure 1:
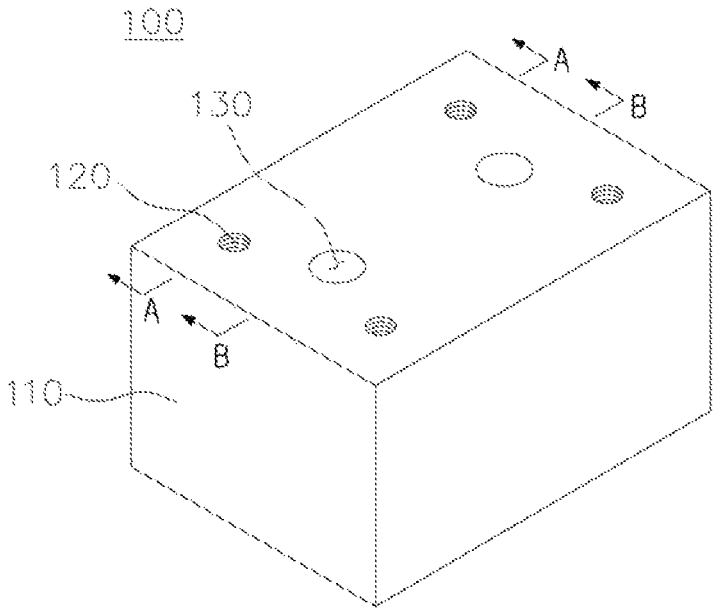
FIG. 1 is a perspective view showing a concrete block according to an embodiment of the present invention.

Hereinbelow, exemplary embodiments of the present invention will be described in detail with reference to the accompanying drawings such that the invention can be easily embodied by one of ordinary skill in the art to which the present invention belongs. However, the present invention may be embodied variously and is not limited to the embodiment described hereinbelow. Throughout the drawings, components incorporated herein will be omitted when it may make the subject matter of the present invention unclear, the same reference numerals will refer to the same or like parts.

Unless the context clearly indicates otherwise, it will be further understood that the terms "comprises", "comprising", "includes", and/or "including", when used herein, specify the presence of stated features, integers, steps, operations, elements, and/or components, but do not preclude the presence or addition of one or more other features, integers, steps, operations, elements, components, and/or groups thereof.

1. Manufacturing Concrete Block

First, a concrete block 100 manufactured according to an embodiment will be described.

Figure 2:
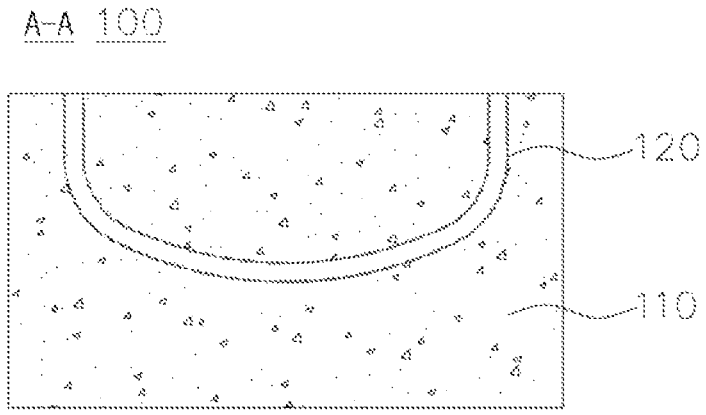
FIG. 2 is a sectional view taken along A-A line of FIG. 1.
Figure 3:
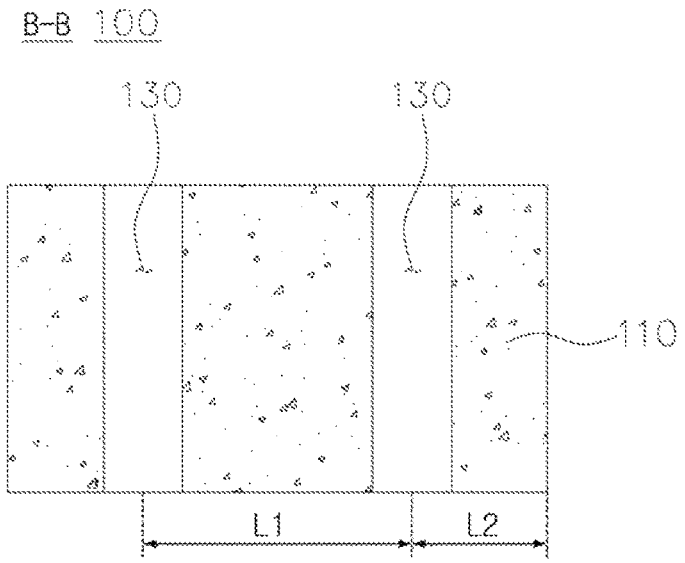
FIG. 3 is a sectional view taken along B-B line of FIG. 1.

FIG. 1 is a perspective view showing the concrete block manufactured according to the exemplary embodiment of the present invention, and FIGS. 2 and 3 are sectional views taken along A-A and B-B lines of FIG. 1.

The concrete block 100 is configured of a concrete block body 110 and a through tube 120 made of a synthetic resin for passing a connecting wire rope. The concrete block body 110 has a plurality of vertical guide holes 130.

As a central part of the through tube 120 for the connecting wire rope is embedded inside the concrete block body 110, the through tube 120 for the connecting wire rope forms a downwardly convex arc along a longitudinal direction. That is, the through tube 120 for the connecting wire rope is arranged in a U-shape.

In addition, both ends of the through tube 120 for the connecting wire rope are arranged on an upper surface of the concrete block body 110 upward.

Since the through tube 120 for the connecting wire rope is made of the synthetic resin tube, the through tube 120 has no risk of corrosion even after prolonged exposure to sea water.

Such through tube 120 for the connecting wire rope is used to lift and place the concrete block 100 using a crane which is a separate lifting means, and technique thereof is described in detail in Korean Patent No. 10-1220995, therefore, a detailed description thereof will be omitted.

Meanwhile, depending on embodiments, in order to lift and place the concrete block 100, a lifting loop member (one of classic lifting and placing methods) which is described as a conventional art in Korean Patent No. 10-1220995 may be used instead of the through tube 120 for the connecting wire rope.

The concrete block 100 has a plurality of vertical guide holes 130 extended in a vertical direction. The vertical guide holes 130 function to guide the concrete block 100 to be seated on an accurate position.

In the embodiment, all concrete blocks 100 each have the plurality of vertical guide holes 130 formed in the vertical direction, and cross-sectional shapes of the vertical guide holes 130 are all the same.

In addition, a center-to-center length (L1) of vertical guide holes adjacent to each other in one concrete block 100 is twice a length (L2) from a first side surface of the concrete block 100 to a center of a vertical guide hole adjacent thereto.

In addition, in the embodiment, it is assumed that the concrete blocks having the same shape are installed. However, this is only for convenience of description, and a concrete block having another shape may be installed according to the technical concept of the present invention.

2. Preparing Guide Member for Installing Concrete Block

Next, a guide member for installing the concrete block 200 of the embodiment will be described.

Figure 4:
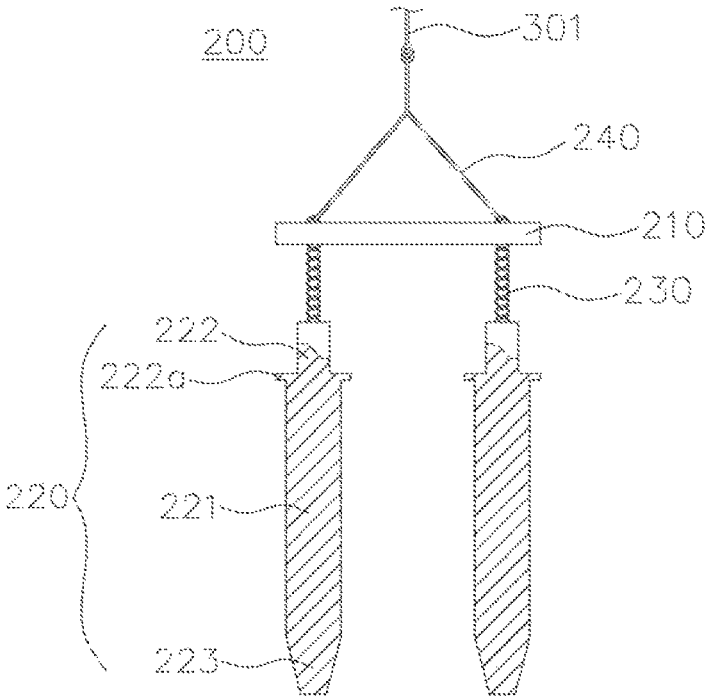
FIG. 4 is a front view showing a guide member for installing the concrete block according to the exemplary embodiment of the present invention.
Figure 5:
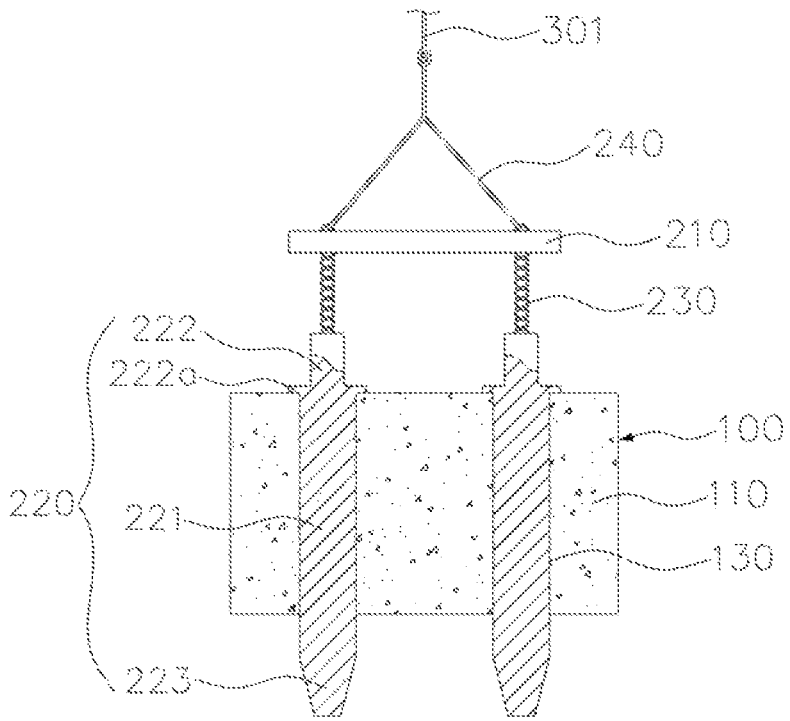
FIG. 5 is a sectional view conceptually showing the guide member for installing the concrete block of FIG. 4 installed in the concrete block of FIG. 1.

FIG. 4 is a front view showing the guide member for installing the concrete block according to the exemplary embodiment of the present invention. FIG. 5 is a sectional view conceptually showing the guide member for installing the concrete block of FIG. 4 installed in the concrete block of FIG. 1.

The guide member for installing concrete block 200 includes a horizontal spacer 210 and a plurality of installation guide poles 220 suspended from both ends of the horizontal spacer.

The horizontal spacer 210 has a bar shape extended horizontally in the embodiment, but shape thereof may be variously changed.

In some cases, the horizontal spacer 210 may have a length variable structure, and in this case, as the length of the horizontal spacer varies, the horizontal spacing between the plurality of installation guide poles 220 may be adjusted.

Each of installation guide poles 220 is provided with a guide body 221 as the center, a cap 222 at an upper part of the guide body and an insertion guide part 223 at a lower part thereof.

The guide body 221 has a shape extended in the vertical direction and is positioned inside each of the vertical guide holes 130 of the concrete block 100.

A cross-sectional shape of the guide body 221 preferably corresponds to a cross-sectional shape of the vertical guide hole 130 of the concrete block 100. That is, when the cross-sectional shape of the vertical guide hole 130 of the concrete block 100 has a circular shape, the cross-sectional shape of the guide body 221 also has the circular shape. Likewise, when the cross-sectional shape of the vertical guide hole 130 of the concrete block 100 has a rectangular shape, the cross-sectional shape of the guide body 221 has the rectangular shape, preferably.

In the embodiment, since the cross-sectional shape of the vertical guide hole 130 of the concrete block 100 has the circular shape, the cross-sectional shape of the guide body 221 has the circular shape.

The cap 222 is formed on the upper part of the guide body 221. The cap 222 has a stopping step 222*a* protruding from a rim of the cap 222.

Therefore, when the guide body 221 is inserted into the vertical guide hole 130 of the concrete block 100, the stopping step 222*a* of the cap 222 stops at an upper surface of the concrete block 100.

The insertion guide part 223 is formed on the lower part of the guide body 221. The insertion guide part 223 has cross-sectional area gradually decreasing in a downward direction. Such shape of the insertion guide part 223 functions to guide the guide body 221 to be easily inserted into the vertical guide hole 130 of the concrete block 100.

The above-mentioned cap 222 of the installation guide pole 220 is suspended from the horizontal spacer 210 by means of a cap connecting member 230. Such coupling form is advantageous by allowing free movement of the installation guide pole 220.

Meanwhile, a center-to-center length in the horizontal direction of the plurality of installation guide poles 220 coupled to the horizontal spacer 210 is the same as the center-to-center length (L1) in the horizontal direction of the vertical guide holes 130 of the concrete block 100.

That is, the center-to-center length in the horizontal direction of the installation guide poles 220 is the same as L1, and is twice L2.

The horizontal spacer 210 is connected to a lifting part 301 of the crane by a crane connecting cable 240, and maintains its horizontality by the crane connecting cable 240.

3. Forming Lower Concrete Block Structure

Figure 6:
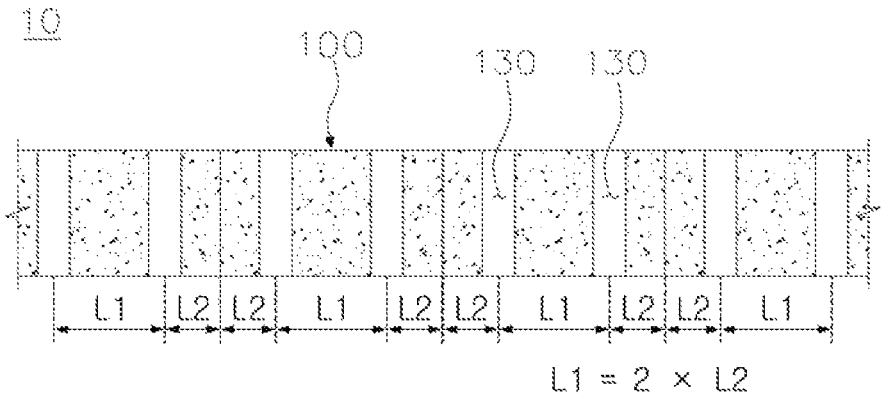
FIG. 6 is a sectional view showing a lower concrete block structure formed of concrete blocks of FIG. 1.

FIG. 6 is a sectional view showing a lower concrete block structure 10 formed of the concrete blocks of FIG. 1.

The concrete blocks 100 of FIG. 1 are installed to be aligned thereby forming the lower concrete block structure 10.

Each concrete block 100 has the plurality of vertical guide holes 130, and the center-to-center length in the horizontal direction of the vertical guide holes 130 of one concrete block 100 (L1) is same as a center-to-center length (2×L2) in the horizontal direction of adjacent vertical guide holes 130 of a pair of concrete blocks 100 adjacent to each other.

The concrete blocks 100 are installed using the through tube 120 for the connecting wire rope, and herein, the detailed description of the through tube will be omitted because the technique thereof is described in detail in Korean Patent No. 10-1220995.

4. Placing Upper Concrete Block

Figure 7:
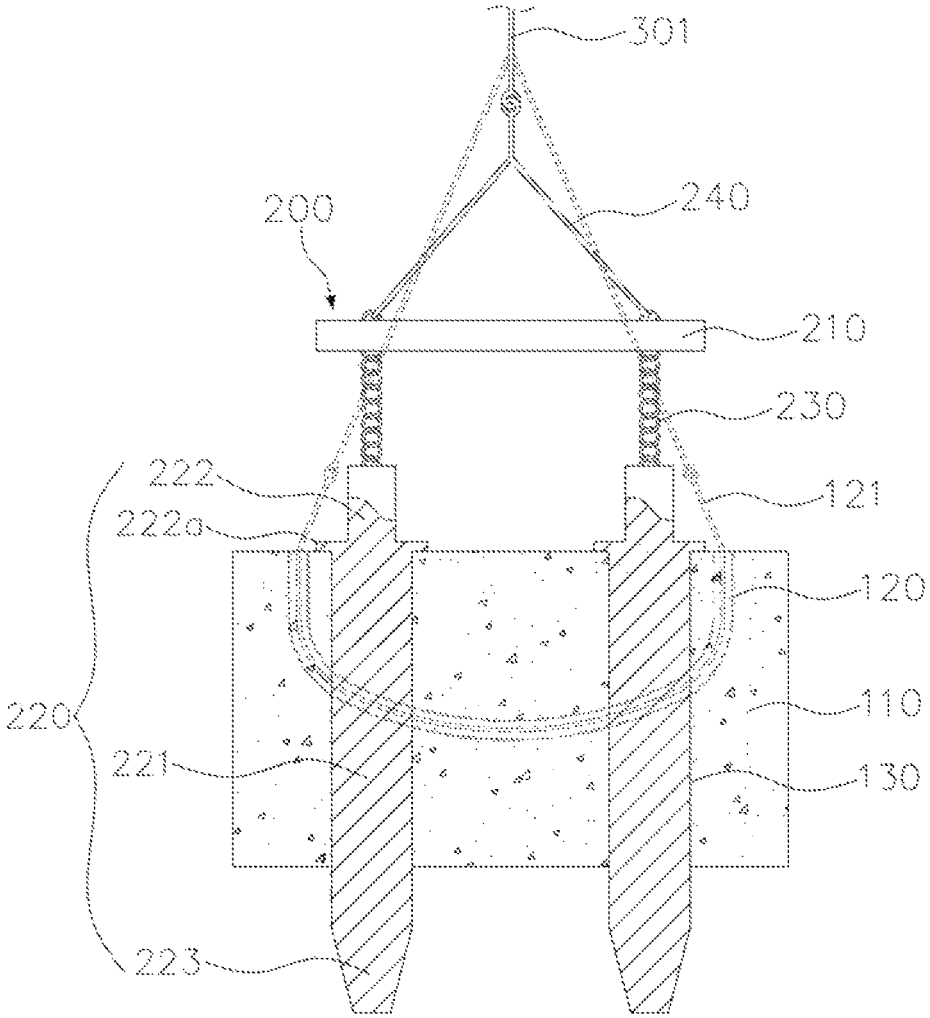
FIG. 7 is a sectional view conceptually showing a state of lifting a concrete block subject to be installed.
Figure 8:
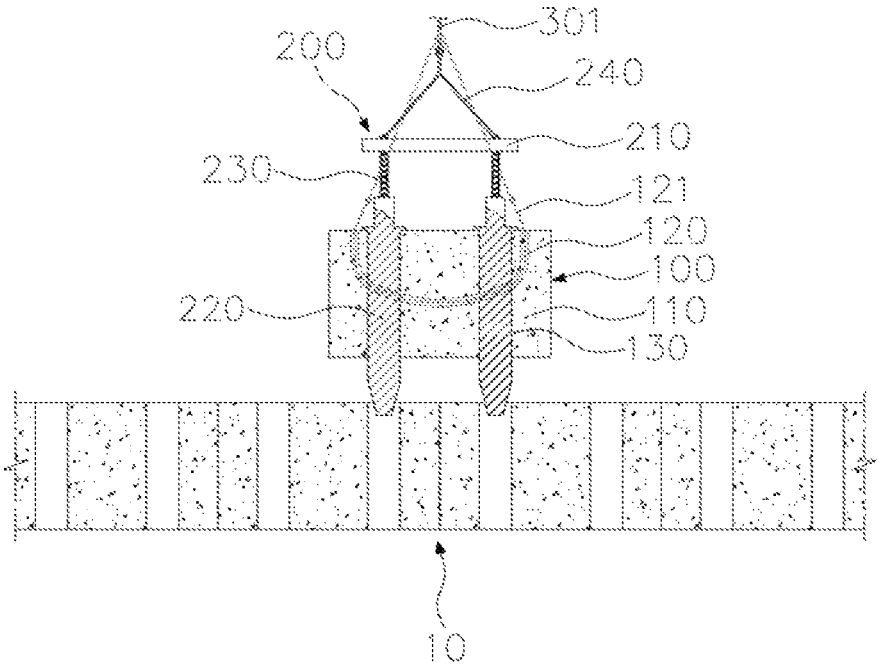
FIGS. 8 and 9 are sectional views showing a state of placing the concrete block subject to be installed.
Figure 9:
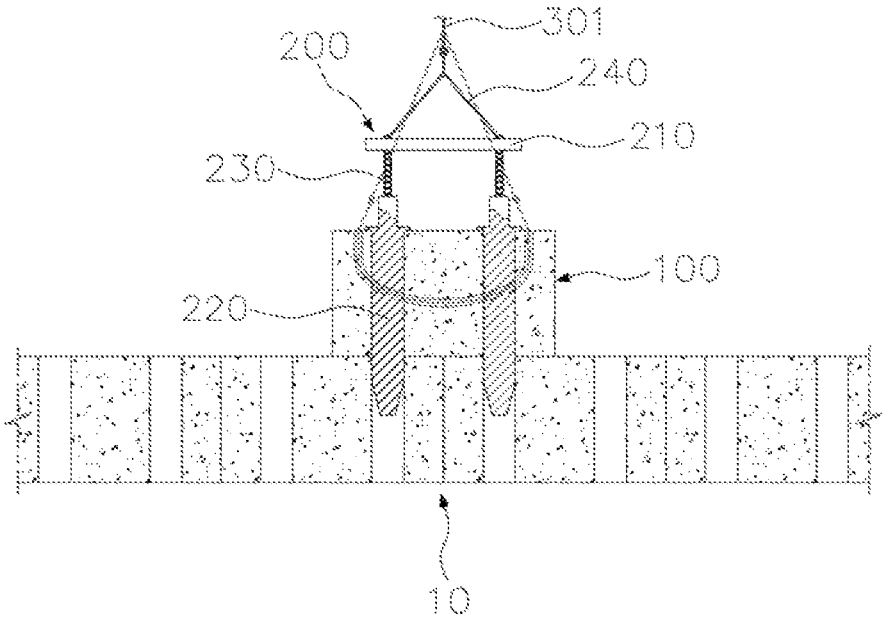

FIG. 7 is a sectional view conceptually showing a state of lifting a concrete block subject to be installed. FIGS. 8 and 9 are sectional views conceptually showing a state of placing the concrete block subject to be installed.

First, the installation guide pole 220 of the guide member for installing the concrete block 200 is inserted into the vertical guide hole 130 of the concrete block 100 subject to be installed.

Here, the cap 222 of the installation guide pole 220 is suspended from the horizontal spacer 210 by the means of the cap connecting member 230, and the insertion guide part 223 of the installation guide pole 220 has a relatively sharp shape on its lower part. Therefore, operation of inserting the installation guide pole 220 into the vertical guide hole 130 proceeds very simply.

As described above, the guide member for installing the concrete block 200 is installed in the concrete block 100, and then the concrete block 100 is lifted using the crane which is the separate lifting means.

That is, as a connecting wire rope 121 passes through the through tube 120 for the connecting wire rope, and both ends of the connecting wire rope 121 are suspended by the lifting part 301 of the crane, the lifting part 301 of the crane lifts the concrete block 100 as shown in FIG. 7.

When the concrete block 100 is lifted, the stopping step 222*a* of the installation guide pole 220 stops at the upper surface of the concrete block 100, the guide body 221 of the installation guide pole 220 is positioned inside the vertical guide hole 130 of the concrete block 100, and the insertion guide part 223 of the installation guide pole 220 protrudes from a bottom of the concrete block 100 subject to be installed.

Meanwhile, in FIG. 7, the installation guide pole 220 is illustrated in a suspended state by the horizontal spacer 210. In practice, however, the installation guide pole 220 is seated in a rested state on the concrete block 100, and the horizontal spacer 210 is placed on the upper surface of the concrete block 100. That is, the cap connecting member 230 and the crane connecting cable 240 preferably are long enough, so that the cap connecting member 230 and the crane connecting cable 240 are in a sagging state rather than a tight state, when the lifting part 301 of the crane lifts the concrete block 100.

As described above, after lifting the concrete block 100 subject to be installed, the concrete block 100 subject to be installed is placed on the lower concrete block structure 10 while be guided by the installation guide pole 220, as shown in FIGS. 8 and 9.

That is, since the lower part of the insertion guide part 223 of the installation guide pole 220 has the relatively sharp shape, operation of inserting the installation guide pole 220 into a vertical guide hole 130 of the lower concrete block structure 10 proceeds very simply. Therefore, the installation guide pole 220 is firstly inserted into the vertical guide hole 130 of the lower concrete block structure 10, and then the concrete block 100 subject to be installed moves downward to an accurate position.

Therefore, as the vertical guide hole 130 of the concrete block 100 subject to be installed is positioned directly above the vertical guide hole 130 of the lower concrete block structure 10, the concrete block 100 subject to be installed is placed on the lower concrete block structure 10.

5. Separating Guide Member for Installing Concrete Block

Figure 10:
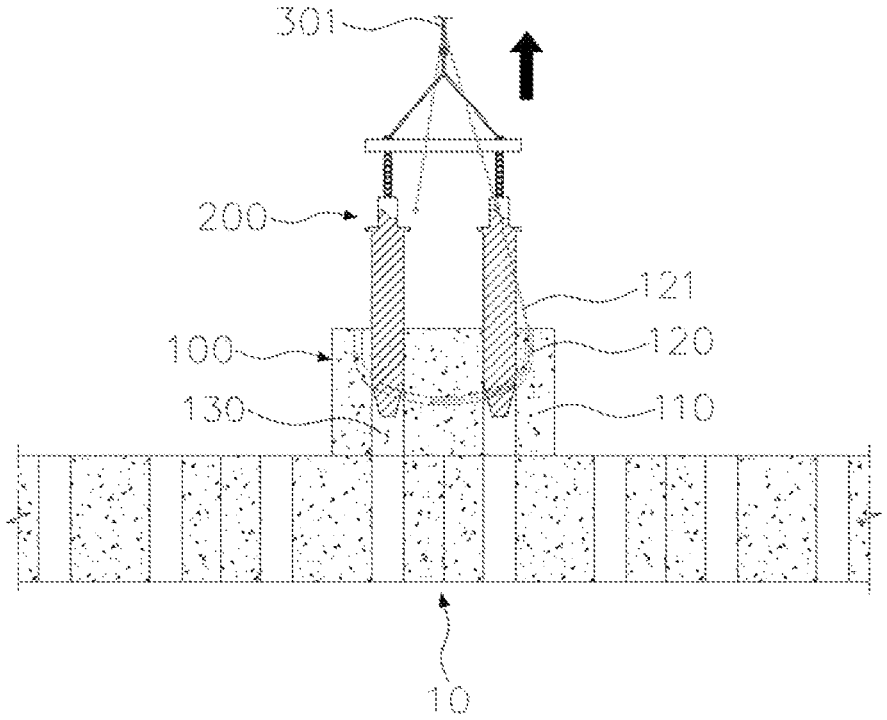
FIG. 10 is a sectional view showing a state of separating a lifting part of a crane from the concrete block.
Figure 11:
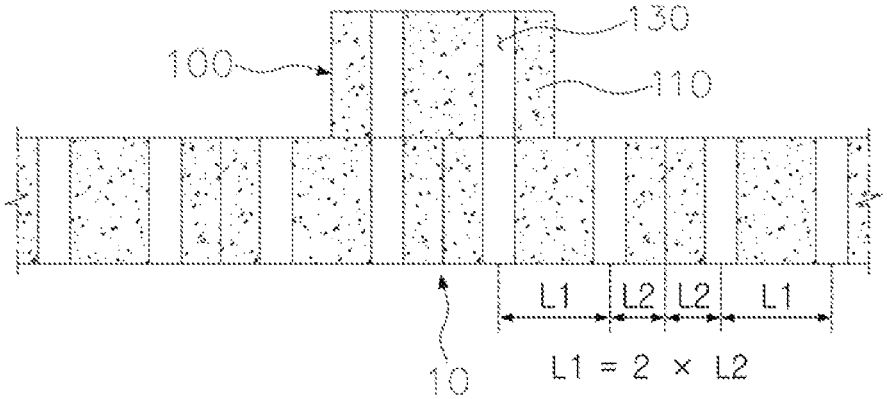
FIGS. 11 and 12 are a sectional view and a perspective view showing a concrete block structure in which the guide member for installing the concrete block is removed through a process of FIG. 10.
Figure 12:
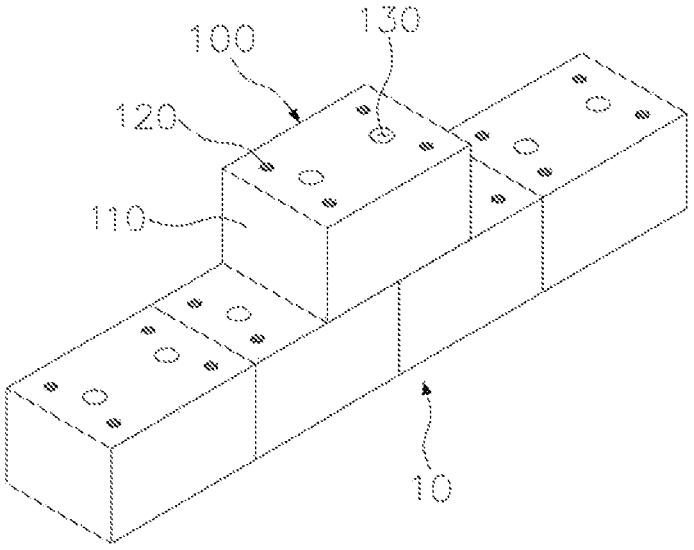

FIG. 10 is a sectional view showing a state of separating the crane lifting part from the concrete block. FIGS. 11 and 12 are a sectional view and a perspective view showing a concrete block structure in which the guide member for installing the concrete block is removed through a process of FIG. 10.

As shown in FIG. 9, after the concrete block 100 subject to be installed is placed, the guide member for installing the concrete block 200 is separated and recovered from the concrete block 100 subject to be installed.

In the embodiment, the guide member for installing the concrete block 200 is connected to the lifting part 301 of the crane by the crane connecting cable 240. Therefore, when the lifting part 301 of the crane is separated from the concrete block 100 subject to be installed and moves upward, the guide member for installing the concrete block 200 also moves upward with the lifting part 301 of the crane thereby separating from the concrete block 100 subject to be installed.

That is, when a first end of the connecting wire rope 121 is separated from the lifting part 301 of the crane, the lifting part 301 of the crane is in a separated state from the concrete block 100. Here, when the lifting part 301 of the crane moves upward, the guide member for installing the concrete block 200 also moves upward with the lifting part 301.

The separated and recovered guide member for installing the concrete block 200 is again used to lift and place another concrete block.

Figure 13:
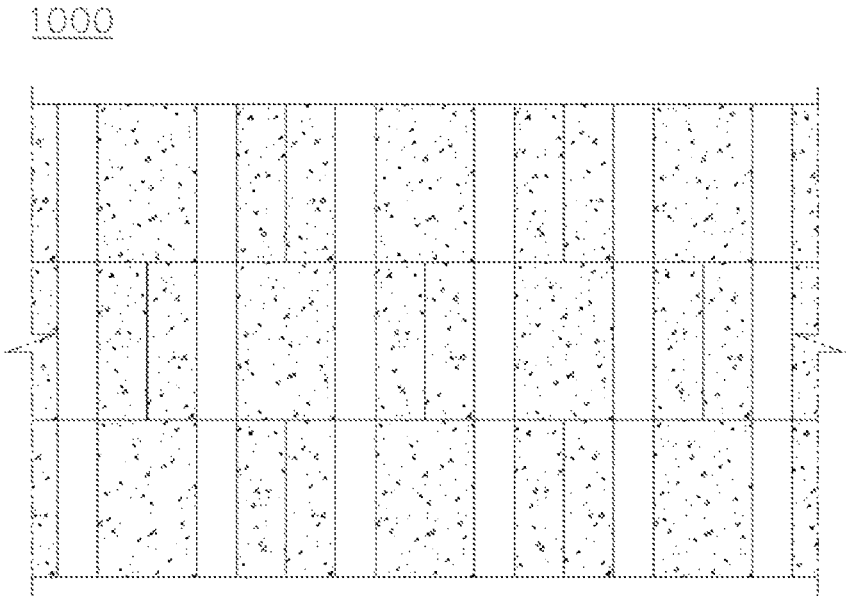
FIG. 13 is a sectional view showing a concrete block structure formed by installing a plurality of concrete blocks by repeating processes of FIGS. 7 to 10.

That is, by repeating the steps 4 and 5, many concrete blocks 100 may be installed to form a concrete block structure 1000 in three stages, as shown in FIG. 13.

FIG. 13 is a sectional view showing the concrete block structure 1000 formed by installing the plurality of concrete blocks by repeating processes of FIGS. 7 to 10.

6. Inserting Vertical Reinforcing Bar Module

Figure 14:
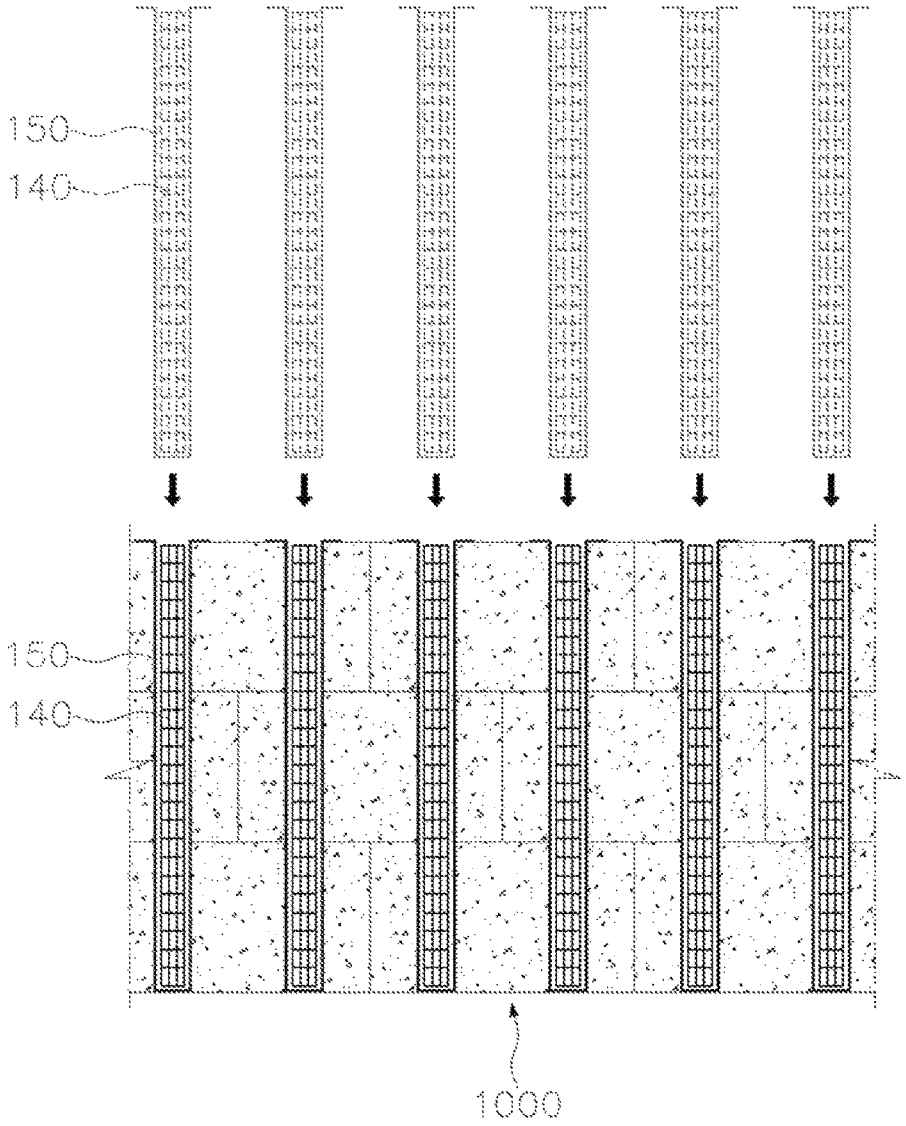
FIG. 14 is a sectional view showing a state in which vertical reinforcement bars are inserted in the concrete block structure of FIG. 13.

After forming as in FIG. 13, a vertical reinforcing bar module 140 is inserted into continuous vertical guide holes 130 of the concrete block structure 1000, as shown in FIG. 14.

FIG. 14 is a sectional view showing a state in which vertical reinforcement bars 140 are inserted in the concrete block structure 1000 of FIG. 13.

The vertical reinforcing bar module 140 may be formed vertically and in a cylinder shape by assembling reinforcing bars, and be inserted into a lower part of the vertical guide holes 130 through an exposed upper part of the vertical guide holes 130.

As described above, when the vertical reinforcing bar module 140 is inserted in the vertical guide holes 130, the vertical reinforcing bar module 140 is positioned inside the continuous vertical guide holes 130 formed by the concrete blocks 100 arranged up and down continuously, as shown in FIG. 14.

In order to solve problems of casting concrete and of internal water when the vertical reinforcing bar module 140 is inserted, the vertical reinforcing bar module 140 is covered by a waterproof membrane 150 on lower and side parts thereof, and then inserted into the vertical guide holes 130.

Therefore, since the vertical reinforcing bar module 140 is inserted with the waterproof membrane 150, the vertical reinforcing bar module 140 is completely prevented from exposure to seawater or a saline component.

7. Forming Vertical Concrete Column for Joining

Figure 15:
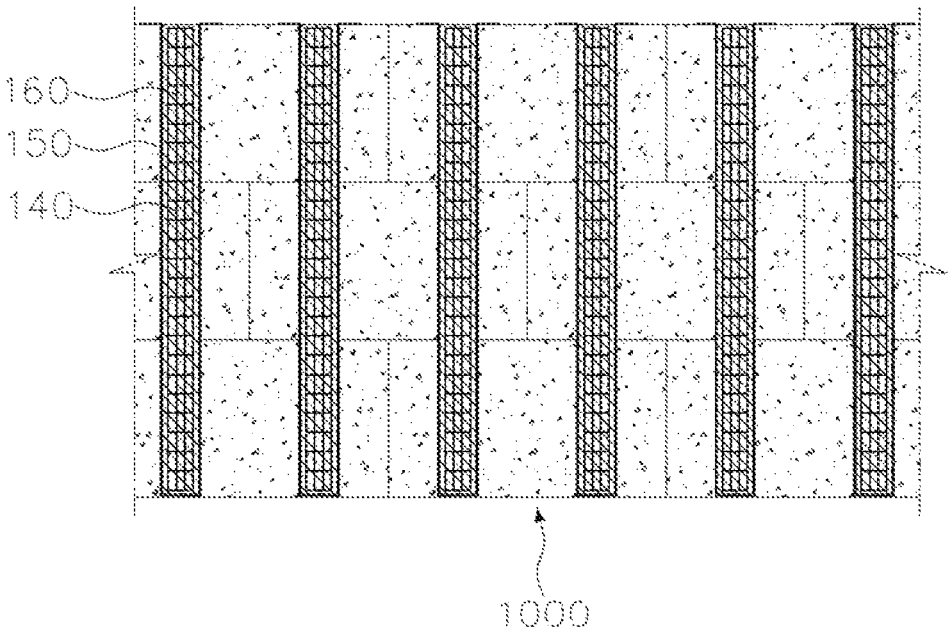
FIG. 15 is a sectional view showing a state in which a vertical concrete column for joining is formed by casting concrete in the concrete block structure of FIG. 14.

FIG. 15 is a sectional view showing a state in which a vertical concrete column for joining is formed by casting concrete in the concrete block structure of FIG. 14.

After FIG. 14, by casing the concrete in the upper part of the vertical guide holes 130 in which the vertical reinforcing bar module 140 is inserted as shown in FIG. 15, the vertical concrete column for joining 160 is formed along the vertical guide holes 130 arranged up and down continuously.

Since the concrete block structure 1000 is joined with strong force by the vertical concrete column for joining 160, thereby having high structural stability, therefore, the concrete block structure 1000 is not easily damaged by ocean waves due to a huge typhoon, etc.

In the embodiment, the vertical guide hole of the concrete block is used in the forming the vertical concrete column for joining. However, the vertical guide hole may be used only in the placing the concrete block, depending on embodiments.

That is, the present invention does not necessarily include the vertical concrete column for joining.

Although a preferred embodiment of the present invention has been described for illustrative purposes, and those skilled in the art will appreciate that various modifications, additions and substitutions are possible, without departing from the scope and of the present invention as disclosed in the accompanying claims. Therefore, it should be understood that the embodiment is not limited to the description hereinabove. For example, each components described in a single form may be embodied in a dispersal form, and components as being dispersed may be embodied in a coupled form.

The scope of the present invention is defined by the accompanying claims rather than the description which is presented above. Moreover, the present invention is intended to cover not only the exemplary embodiments, but also various alternatives, modifications, equivalents and other embodiments that may be included within the spirit and scope of the present invention as defined by the appended claims.

The invention claimed is:

1. A concrete block construction method, the method comprising:

manufacturing a plurality of concrete blocks each having a vertical guide hole formed in a vertical direction;

preparing a guide member for installing the concrete blocks, the guide member includes an installation guide pole provided with a guide body having a cross-sectional shape corresponding to the vertical guide hole and extended in the vertical direction, a cap formed on an upper part of the guide body and having a stopping step protruding from a rim thereof, and an insertion guide part positioned at a lower part of the guide body and of which a cross-sectional area gradually decreases in a downward direction;

forming a lower concrete block structure by installing at least one of the concrete blocks;

placing the concrete block subject to be installed on the lower concrete block structure by inserting the installation guide pole into the vertical guide hole of the concrete block subject to be installed, positioning the guide body inside the vertical guide hole of the concrete block subject to be installed until the stopping step of the cap stops at an upper surface of the concrete block subject to be installed, lifting the concrete block subject to be installed using a separate lifting means while the insertion guide part protrudes from a bottom of the concrete block subject to be installed, and then inserting the insertion guide part of the installation guide pole into a vertical guide hole of the lower concrete block structure and placing the concrete block subject to be installed on the lower concrete block structure, so that the vertical guide hole of the concrete block subject to be installed is positioned directly above the vertical guide hole of the lower concrete block structure with guidance of the installation guide pole; and separating and recovering the guide member for installing the concrete block from the concrete block subject to be installed, after placing the concrete block subject to be installed.

2. The method of claim 1, wherein the guide member for installing the concrete block includes a plurality of installation guide poles and a horizontal spacer from which the plurality of installation guide poles are suspended while maintaining horizontal spacing therebetween, a plurality of vertical guide holes are formed on the concrete block, and a center-to-center length in a horizontal direction of the vertical guide holes adjacent to each other is twice a length from a first side of the concrete block to a center of an adjacent vertical guide hole.

3. The method of claim 2, wherein the guide member for installing the concrete block further includes:

a crane connecting cable for connecting a lifting part of a crane and the horizontal spacer, wherein, when the lifting part of the crane is separated from the concrete block subject to be installed, the guide member for installing the concrete block is separated from the concrete block subject to be installed with the lifting part of the crane.

4. The method of claim 3, further comprising:

inserting a vertical reinforcing bar module into vertical guide holes of the plurality of concrete blocks arranged continuously in the vertical direction, by inserting the vertical reinforcing bar module which is formed vertically and covered by a waterproof membrane on lower and side parts thereof into the vertical guide hole downwardly, after the guide member for installing the concrete block is separated from the concrete block subject to be installed; and forming a vertical concrete column for joining formed along the vertical guide holes arranged in the vertical direction by casting concrete in the guide holes in which the vertical reinforcing bar module is inserted.

5. A guide member for installing a concrete block, for guiding the concrete block to a placing position of the concrete block, when the concrete block having a plurality of guide holes extended in a vertical direction and are spaced from each other in a horizontal direction is being placed, the guide member comprising:

a horizontal spacer extended in the horizontal direction;

a plurality of installation guide poles each including a guide body extended in the vertical direction so as to be inserted into a vertical guide hole of the concrete block, a cap formed on an upper part of the guide body and having a stopping step protruding so that the cap stops at an upper surface of the concrete block when the guide body is in an inserted state in the vertical guide hole, and an insertion guide part that is formed on a lower part of the guide body, has a cross-sectional area gradually decreasing in a downward direction, and protrudes from a bottom of the concrete block when the guide body is inserted in the guide hole of the concrete block; and a cap connecting member for connecting the cap and the horizontal spacer so that the plurality of the installation guide poles are suspended from the horizontal spacer while maintaining horizontal spacing therebetween, and for allowing the installation guide poles to move freely.

6. The guide member of claim 5, wherein the horizontal spacer has a length variable structure, and the horizontal spacing between the plurality of installation guide poles is adjusted by the variable length of the horizontal spacer.

* * * * *